United States Patent [19]

Bellingham et al.

[11] Patent Number: 4,694,666

[45] Date of Patent: Sep. 22, 1987

[54] SHACKLE MECHANISMS

[75] Inventors: Ronald S. Bellingham, Bilston; Malcolm J. White, Lichfield, both of England

[73] Assignee: Chubb & Son's Lock and Safe Company Limited, Feltham, England

[21] Appl. No.: 800,622

[22] Filed: Nov. 21, 1985

[30] Foreign Application Priority Data

Dec. 13, 1984 [GB] United Kingdom ..... 8431516

[51] Int. Cl.[4] ..... E05B 75/00

[52] U.S. Cl. ..... 70/16

[58] Field of Search ..... 70/16, 15, 17

[56] References Cited

U.S. PATENT DOCUMENTS

| | | | |
|---|---|---|---|
| 222,751 | 12/1879 | Tower et al. | 70/16 |
| 470,869 | 3/1892 | Kahlke | 70/16 |
| 636,589 | 11/1899 | Tower | 70/16 |
| 930,014 | 8/1909 | Wood | 70/16 |
| 1,531,451 | 3/1925 | Neal | 70/16 |
| 1,845,511 | 2/1932 | Neal | 70/16 |
| 1,851,206 | 3/1932 | Neal | 70/16 |
| 4,509,346 | 4/1985 | Szczepanek | 70/16 |

FOREIGN PATENT DOCUMENTS

| | | | |
|---|---|---|---|
| 958432 | 9/1949 | France | 70/16 |
| 11787 | 5/1904 | United Kingdom | 70/16 |

*Primary Examiner*—Gary L. Smith
*Assistant Examiner*—Lloyd A. Gall
*Attorney, Agent, or Firm*—Pollock, Vande Sande and Priddy

[57] ABSTRACT

An "arrest" handcuff has the usual ratchet and pawl mechanism for closing the wrist aperture. In order to deadlock the pawl a runner is shifted by means of a manual push-button so that a stump on the runner then overlies a nose portion of the pawl. To release the deadlocking and pivot the pawl clear of the ratchet the runner must be shifted in the reverse direction, which movement is normally blocked by a lever pack operating on a stump extending from the runner. A correct key, however, can lift the levers and turn the runner back so that a further stump carried by the runner engages a tail portion of the pawl to lift it from the rathet. If the option to deadlock the pawl is not taken up in any particular arrest situation the pawl still remains engaged with the ratchet under a spring bias and the correct key is still needed to perform a reverse movement of the runner to lift the pawl from the ratchet.

2 Claims, 2 Drawing Figures

SHACKLE MECHANISMS

BACKGROUND OF THE INVENTION

The present invention relates to shackle mechanisms and is particularly concerned with handcuffs of the so-called "arrest" type.

The conventional "arrest" handcuff comprises a pair of arcuate arms pivoted together at one of their respective ends and interengageable at their other respective ends so as collectively to encircle the wrist. One arm (which, for convenience, we shall refer to as the "locking arm") is formed with a series of ratchet teeth on its convex side at its end remote from the aforesaid pivot while the other arm (which, for convenience, we shall refer to as the "receiving arm") extends from a casing which houses a spring-biased pawl for engagement with the ratchet teeth of the locking arm. The ratchet teeth and pawl are so arranged as to permit continuous 360° rotation of the locking arm relative to the receiving arm in the direction which closes the wrist aperture defined by the arms but to prevent rotation of the locking arm relative to the receiving arm in the opposite direction when the ratchet teeth and pawl are in contact. When making an arrest, therefore, the receiving arm is placed against the wrist of the subject and the locking arm is swung into engagement therewith until it meets the obstruction of the now-encircled wrist; from this condition the locking arm is automatically prevented from withdrawal by virtue of the engagement of its ratchet teeth with the pawl of the receiving arm acting under the aforesaid spring bias. To release the cuff a simple "key" is provided to the proper authorities which when inserted into the pawl casing and turned in the appropriate direction engages the pawl to lift it out of engagement with the ratchet teeth against the action of its spring bias, thus to permit rotation of the locking arm away from the receiving arm.

Handcuffs operating on the above principle have been used for many years. Nevertheless, the existing forms of cuff still have certain drawbacks from the point of view of security. In particular, the absence of a secure key-recognition mechanism which must be operated before the pawl is lifted to release the locking arm means that these devices are relatively vulnerable to picking. It is true that in certain designs additional "deadlocking" means are provided which can be applied to block the lifting of the pawl if an additional manipulation is performed by the arresting officer after the cuff has been fitted to the subject's wrist—such as the slidable bolt disclosed in U.S. Pat. No. 1,161,562. However the mechanism shown in the above-mentioned specification is typical of such known devices in that the aforesaid bolt is arranged to be released by the same operation of the same simple "key" as is used to lift the pawl against its spring bias, and is unprotected by any proper key-recognition mechanism.

SUMMARY OF THE INVENTION

It is an aim of the present invention to provide an "arrest" type handcuff or similar shackle device with greater security against picking than is exhibited by the known forms of cuff referred to above, and accordingly the invention resides in a shackle device comprising a pair of arms pivoted together at one of their respective ends and interengagable at their other respective ends so as collectively to encircle part of subject's body; a first said arm being formed with a series of ratchet teeth on its convex side at its end remote from the aforesaid pivot and the second said arm extending from a casing which houses a resiliently-biased pawl for engagement with said teeth; the aforesaid ratchet teeth and pawl being so arranged as to permit continuous 360° rotation of the first arm relative to the second arm in the direction which closes the aperture defined by said arms but to prevent rotation of the first arm relative to the second arm in the opposite direction when the ratchet teeth and pawl are in contact; a key-engageable runner slidably born in said casing and adapted to lift said pawl out of contact with said ratchet teeth against the action of said resilient bias when said runner is slid from a predetermined first position to a predetermined second position by the rotation of a correct key within said casing in a predetermined direction; and a plurality of pivoted, key-engageable locking levers housed in said casing and biased to respective locking positions; each said lever having a formation with which an abutment portion of the runner engages when the runner is in its said first position and the levers are in their locking positions, so as to block the movement of the runner from its said first position to its said second position, but said levers being pivotable to respective unlocking positions in which each said formation disengages from said abutment portion so as to permit the aforesaid movement of the runner, by the rotation of the correct key within said casing in its said direction.

In order furthermore to deadlock the pawl when in contact with said ratchet teeth the runner is also preferably arranged to slide from its said first position to a predetermined third position, in the direction opposite to the direction of its movement from its first to its second position, in which third position a portion of the runner overlies a portion of the pawl to block the latter from lifting out of contact with the ratchet teeth; and each said lever preferably has a second formation with which said abutment portion of the runner engages when the runner is in its said third position and the levers are in their locking positions, so as to block movement of the runner from its third to its first position, but each said second formation disengaging from said abutment portion so as to permit such movement of the runner when the levers are pivoted to their unlocking positions by the rotation of the correct key within said casing in its said direction.

While the above-defined deadlocking movement of the runner may, if desired, be made in response to rotation of the correct key within said casing in the direction opposite to its first-mentioned direction, it is more preferably arranged that the runner can be slid manually from its first to its third position without the use of the key or of any other tool. The runner may therefore have a portion accessible within a recess or aperture of said casing and configured for sliding operation by the finger or thumb of an officer in an "arrest" situation. It is important that operation of the runner to deadlock the pawl can be effected with ease by a trained officer in such an "arrest" situation—bearing in mind that a subject to whom the shackle is to be applied may struggle or otherwise seek to impede the application and deadlocking of the device—while at the same time the design of the operating portion should be such as to guard against accidental operation—in a struggle, for example—before the shackle has been applied, because once the pawl has been deadlocked further movement of the locking arm (which bears the ratchet teeth) to close the shackle is precluded. It is also necessary, when this manual deadlocking operation is to be provided, that the levers are configured to permit the movement of the runner from its first to its third position (in which position the levers block return movement of the runner) without being pivoted to their unlocking positions by means of the key. The levers may therefore each be configured with a notch which provides the first-mentioned formation with which the abutment portion of the runner engages when in its first position, which notch and/or abutment portion has a face inclined to the direction of movement of the runner from its first to its third position whereby movement of the runner in that direction cams the levers away from their locking positions until the runner reaches its third position, whence the levers return to their locking positions under the aforesaid bias to engage their aforesaid second formations with the abutment portion.

The invention will now be more particularly described, by way of example, with reference to the accompanying drawings, in which:

DESCRIPTION OF THE PREFERRED EMBODIMENTS

Figure 1:
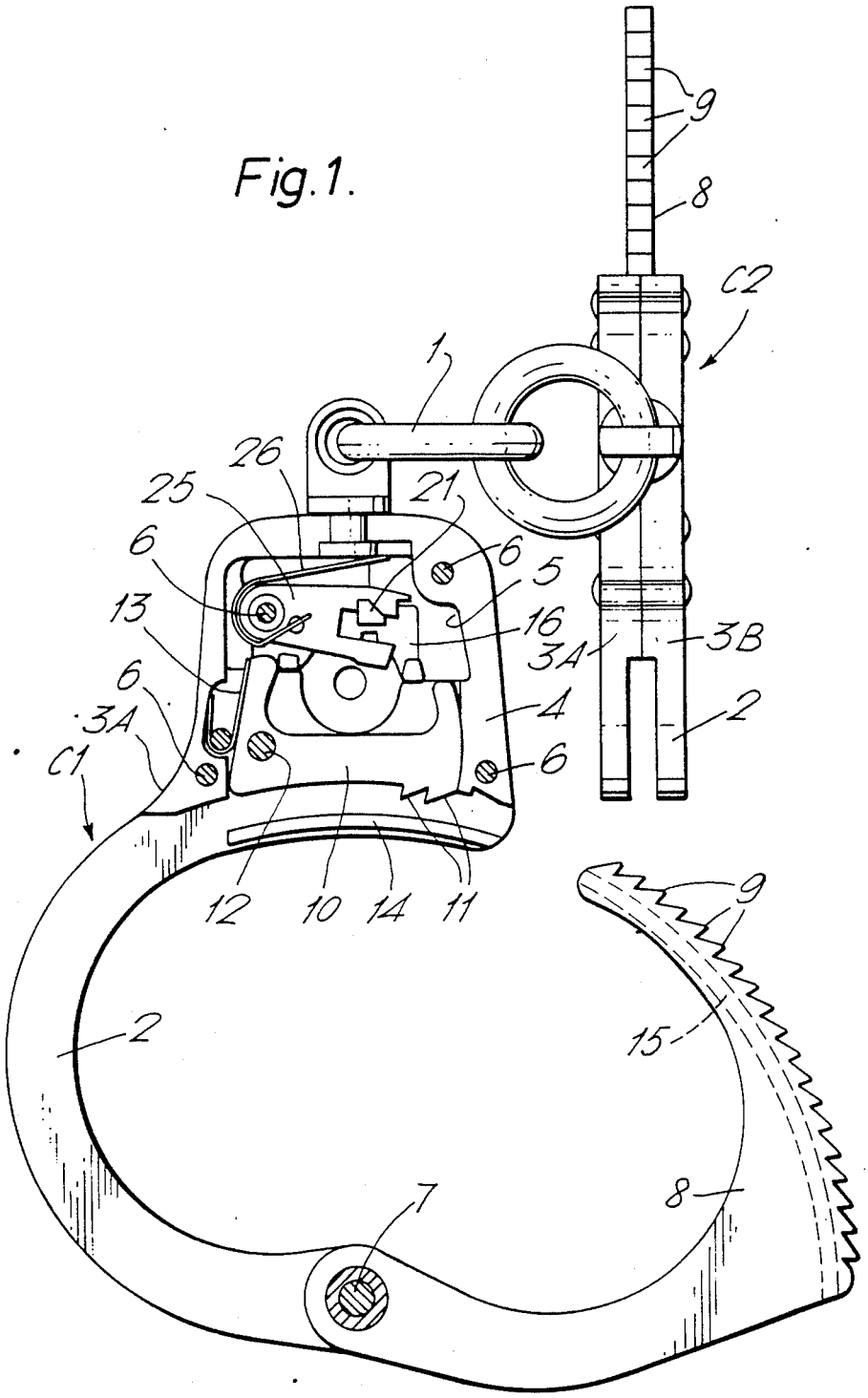
FIG. 1 shows a pair of "arrest" handcuffs made according to the invention with one of the side plates of one of the cuffs removed to reveal its locking mechanism.

The handcuff C1 illustrated in detail in the drawings is one of a pair of cuffs linked together by the usual chain 1. The second cuff C2 is identical in construction and operation to the cuff C1 and need not therefore be separately described. Each includes an arcuate receiving arm 2 defined by spaced-apart portions of a pair of side plates 3A and 3B. Adjacent to arm 2 these plates have profiled flanges 4 which collectively define a casing 5 which houses the locking components described below. The plate flanges are rigidly secured together by four rivets 6, a further rivet 7 interconnecting the distal ends of the side plates and serving also as the pivot for an arcuate locking arm 8.

The arm 8 has a series of ratchet teeth 9 formed on its convex side at its end remote from the rivet 7. For cooperation with these teeth a pawl 10 having teeth 11 is pivoted on a pin 12 within the casing 5 and is resiliently biased in the clockwise sense (as viewed in the drawings) by a spring 13. The slopes of the teeth 9 and 11 are arranged so that, in the illustrated condition, if the arm 8 is pivoted relative to the arm 2 in the anticlockwise sense (as viewed in the drawings)—i.e. in the closing direction of the wrist aperture—the pawl 10 can ride over the teeth 9 against its spring bias and, if otherwise unobstructed, the arm 8 can perform complete anticlockwise revolutions relative to the arm 2, passing through the space between the arcuate portions of the plates 3A and 3B. However, while there is contact between the teeth 9 and 11 their interengagement prevents relative movement between arms 8 and 2 in the opposite sense—i.e. in the direction to open the wrist aperture. To apply the cuff, therefore, it is first made ready, if not already open, by passing the locking arm 8 anticlockwise all the way through the receiving arm 2; the receiving arm 2 is placed against the wrist and the locking arm 8 is swung towards it in the anticlockwise sense until (with the pawl 10 running over the teeth 9), the obstruction of the now-encircled wrist is met, in which condition the arm 8 is automatically locked against withdrawal from the arm 2 by the engagement of the pawl 10 at whichever position along the track of teeth 9 it has reached. A rigid rib 14 upstanding from the plate 3A engages in a groove 15 in the facing flank of the arm 8 to resist bending of the arm 8 away from the pawl 10 in this condition.

Figure 2:
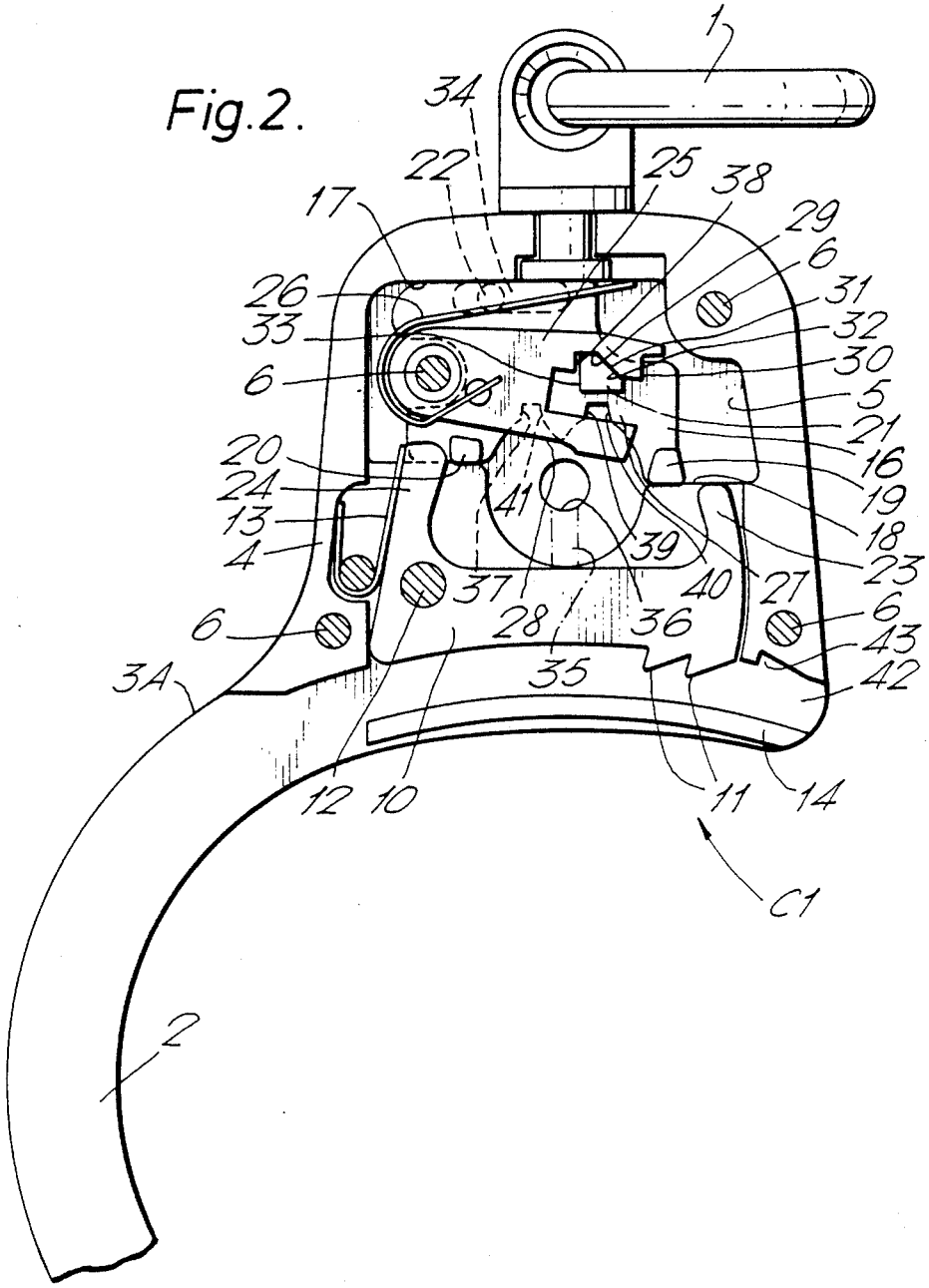
FIG. 2 illustrates the cuff locking mechanism of FIG. 1 to an enlarged scale.

Turning now to the other components of the handcuff housed within the casing 5 as shown particularly in FIG. 2, a runner 16 is borne for reciprocation in a channel formed between the top wall 17 of the casing and a ledge 18 formed on the plate 3A above the pawl 10. This runner is in the form of a profiled plate with three upstanding stumps 19–21 and also a push-button 22 which extends from the reverse side of the runner to lie in a slot 34 in the side plate 3A and which is directly engageable by the finger or thumb of an officer for manual movement in slot 34. Movement of the runner 16 to the right from its position illustrated in FIG. 2 places the stump 19 behind the nose 23 of the pawl 10 to deadlock the pawl in its teeth-engaged position, and movement of the runner in the opposite direction causes the stump 20 to engage the tail 24 of the pawl and pivot the latter out of engagement with the locking arm 8. Any such leftward movement of the runner 16 is, however, normally blocked by a pack of, say, three locking levers 25 pivoted on one of the rivets 6 and biased by springs 26 in the clockwise sense (as viewed in the drawings). Each lever 25 has a generally rectangular open-ended slot 27 of a depth just sufficient to accommodate the runner stump 21, the slot 27 in each different lever being at a different height from the belly 28 of the respective lever. Each such slot 27 also includes a transverse extension in its top surface defining a pocket formation 29 complementary to the profile of the upper part of the stump 21 and a second transverse extension defining a shoulder or vestigal pocket formation 30 at the free end of the slot.

FIG. 2 illustrates the locking mechanism in the condition in which the cuff is in readiness for use. If after applying the cuff it is desired to deadlock the pawl 10, all that is required is for the officer to press the button 22 of the runner 16 to engage push-button 22 with his hand and to the right (as viewed in the Figure) along slot 34 to slide the runner into the position in which its stump 19 overlies the pawl nose 23. It will be observed that the face 31 of the runner stump 21, and the cooperating face 32 of the pocket formation 29 in each lever 25, are inclined to the direction of movement of the runner into its deadlocking position, so that as the runner moves the levers 25 are cammed away from their locking positions by the stump 21, against the bias of the springs 26. The levers remain lifted by the stump 21 until the latter encounters the lever shoulders 30, at which point the levers spring back to their locking positions, the face 33 of the stump 21 now therefore abutting the shoulders 30 to block return movement of the runner from its deadlocking position.

To open the handcuff from its deadlocked condition the correct key is taken and inserted through a keyhole 35 provided in the plate 3B. For the illustrated embodiment the key to be used is a 'pin' key, to be turned in a journal 36 in the plate 3A and having a multi-stepped bit matched to the required lifts of the respective levers 25. The key is turned anticlockwise through a complete revolution, to lift the levers and disengage their shoulders 30 from the runner stump 21, the key bit also engaging a drive face 37 on the runner to shift the latter back to its FIG. 2 position as the stump 21 passes back through the lever slots 27 to lie beneath the pockets 29. As the key releases the levers they return to their locking positions, the face 33 of the stump 21 now abutting the face 38 of each lever pocket formation 29 to block further leftward movment of the runner 16. The key is given a further, partial anticlockwise turn to lift the levers again and release the stump 21 from the pockets 29. The key bit also engages another drive face 39 on the runner at this time to shift the latter leftwards so that its stump 20 pivots the pawl 10 against its spring bias 13 to release the locking arm 8, and in so doing the stump 21 passes along the inner end of each lever slot 27.

Having lifted the pawl 10, further turning of the key is blocked by the runner 16 and to remove the key it is turned back clockwise to align with the keyhole 35, in so doing the pawl, runner and levers being returned to the "readiness" condition illustrated in FIG. 2 by the action of the springs 13 and 26. A further drive surface 40 is nevertheless provided on the runner 16 to return it positively by the key in the unlikely event of sticking or failure of the spring 13. A still further drive surface 41 is in fact also provided by which the runner 16 can be shifted to its deadlocking position by use of the key, although this will not normally be required when the option of manual push-button operation as described above is available.

Of course it may be in any given arrest situation that the option to deadlock the pawl 10 is not taken up. In this case the arm 8 is still held against withdrawal from the pawl by the engagement of the teeth 9/11, the pawl being held under the action of the spring 13. To open the cuff from this condition it is still necessary to use the key, to perform the second part of the unlocking operation described above.

In order to provide protection against attempts to push back the pawl 10 when it is only spring-locked, by poking a thin strip of material into the entrance 42 of the receiving arm and between the teeth 9/11, a slot 43 is provided in the side plates at this position designed to trap any such object.

We claim:

1. The combination of a shackle device an a correct key therefor, the shackle device comprising a pair of arms pivoted together at one of their respective ends and interengageable at their other respective ends so as collectively to encircle part of a subject's body; a first said arm being formed with a series of ratchet teeth on its convex side at its end remote from the aforesaid pivot and the second said arm extending from a casing which houses a resiliently-biased pawl for engagement with said teeth; the aforesaid ratchet teeth and pawl being so arranged as to permit continuous 360° rotation of the first arm relative to the second arm in the direction which closes the aperture defined by said arms but to prevent rotation of the first arm relative to the second arm in the opposite direction when the ratchet teeth and pawl are in contact; a key-engageable runner slidably borne in said casing and adapted to lift said pawl out of contact with said ratchet teeth against the action of said resilient bias when said runner is slid from a predetermined first position to a predetermined second position by the rotation of the correct key within said casing in a predetermined direction; the runner further having a manually-engageable portion extending outside of said casing for actuation by the finger or thumb of a person applying the shackle device for manually sliding the runner from its said first position to a predetermined third position, in the direction opposite to the direction of its movement from its first to its second position, in which third position a portion of the runner overlies a portion of the pawl to block the pawl from lifting out of contact with the ratchet teeth; a plurality of pivoted, key-engageable locking levers housed in said casing and biased to respective locking positions; each said lever having a first formation with which an abutment portion of the runner engages when the runner is in its said first position and the levers are in their locking positions, so as to block the movement of the runner from its said first position to its said second position, but said levers being pivotable to respective unlocking positions in which each said formation disengages from said abutment portion so as to permit such movement of the runner, by the rotation of the correct key within said casing in its said direction; each said lever having a second formation with which said abutment portion of the runner engages when the runner is in its said third position and the levers are in their locking positions, so as to block movement of the runner from its third to its first position, but each said second formation being arranged to disengage from said abutment portion so as to permit such movement of the runner when the levers are pivoted to their unlocking positions by the rotation of the correct key within said casing in its said direction; and at least one of said first formation of each lever and said abutment portion of the runner having a face inclined to the direction of movement of the runner from its first to its third position whereby movement of the runner in that direction by manipulation of said manually-engageable portion cams the levers away from their locking positions until the runner reaches its third position, whence the levers return to their locking positions under their aforesaid bias to engage their aforesaid second formations with the abutment portion.

2. The shackle device and correct key combinations according to claim 1 wherein the runner is a generally planar element from which a stump upstands to define said abutment portion; said levers being planar elements which are disposed in overlapping parallel relationship to the runner; each said lever having a slot which, when the levers are in their respective unlocking positions, is aligned parallel with the direction of movement of the runner and within which said stump can travel when the runner moves from its first to its second position; the transverse dimension of at least parts of said slots within which said stump so travels only just exceeding the transverse dimension of the stump; and said slots having transverse extensions within which said stump lies when the levers are in their respective locking positions and the runner is in its first position, to block movement of the runner to its second position.

* * * * *